US007241168B2

(12) United States Patent
Sakurai et al.

(10) Patent No.: US 7,241,168 B2
(45) Date of Patent: Jul. 10, 2007

(54) JOINT CONNECTOR AND METHOD OF ASSEMBLING IT

(75) Inventors: Toshikazu Sakurai, Yokkaichi (JP); Atsushi Sakatani, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/371,461

(22) Filed: Mar. 9, 2006

(65) Prior Publication Data

US 2006/0205270 A1 Sep. 14, 2006

(30) Foreign Application Priority Data

Mar. 11, 2005 (JP) ..... 2005-069384

(51) Int. Cl.
*H01R 31/08* (2006.01)

(52) U.S. Cl. ..... 439/511

(58) Field of Classification Search ..... 439/189, 439/511, 516, 595

See application file for complete search history.

(56) References Cited

U.S. PATENT DOCUMENTS 5,112,239 A * 5/1992 Yagi et al. ..... 439/189
5,201,667 A * 4/1993 Endo et al. ..... 439/189
5,403,204 A * 4/1995 Chishima et al. ..... 439/513
5,662,487 A * 9/1997 Okamura et al. ..... 439/189
6,186,806 B1 2/2001 Suzuki et al.
6,193,549 B1 * 2/2001 Suzuki et al. ..... 439/589
6,276,964 B1 8/2001 Shinozaki
6,290,521 B1 * 9/2001 Suzuki et al. ..... 439/189
6,447,331 B1 9/2002 Fukatsu et al.
6,878,017 B2 4/2005 Sakurai et al.

FOREIGN PATENT DOCUMENTS

EP 0 772 258 A1 5/1997

* cited by examiner

*Primary Examiner*—Neil Abrams
*Assistant Examiner*—Phuongchi Nguyen
(74) *Attorney, Agent, or Firm*—Gerald E. Hespos; Anthony J. Casella

(57) ABSTRACT

A joint connector has a housing (10) with insertion spaces (11) for receiving terminal fittings (20). A joint terminal (30) is mounted in the housing (10) at a first position where the joint terminal (30) is retracted from the insertion spaces (11). The terminal fittings (20) then are inserted into the insertion spaces (11) of the housing (10). The joint terminal (30) then is displaced to a full locking position for contacting and shorting the terminal fittings (20). As a result, the joint terminal (30) does not hinder insertion of the terminal fittings (20). Furthermore, the joint terminal (30) is mounted directly in the housing (10) and does not require a separate holder. Thus, the number of parts is reduced.

13 Claims, 5 Drawing Sheets

JOINT CONNECTOR AND METHOD OF ASSEMBLING IT

BACKGROUND OF THE INVENTION

1. Field of the Invention

The invention relates to a joint connector and to a method of assembling it.

2. Description of the Related Art

U.S. Pat. No. 6,878,017 discloses a joint connector that has a housing and a plurality of terminal fittings mounted in the housing. A joint terminal is mounted in a holder and has a plurality of contact portions. The contact portions can be brought into contact with the terminal fittings in the housing to short the terminal fittings.

The number of parts of the joint connector could be reduced by eliminating the holder and mounting the joint terminal in the housing. However, a connection resistance is produced between the joint terminal and the terminal fittings when the terminal fittings are inserted into the housing and creates a reaction force against the insertion. The terminal fittings often are inserted into the housing by gripping wires connected with the terminal fittings. However, the above-described connection resistance causes the wires to buckle, thereby making it impossible to insert the terminal fittings.

The invention was developed in view of the above problem and an object thereof is to reduce the number of parts without hindering the insertion of terminal fittings into a housing.

SUMMARY OF THE INVENTION

The invention relates to a joint connector that has a housing with insertion spaces fro receiving terminal fittings. The joint connector also has a joint terminal for contacting and shorting the terminal fittings. The joint terminal is mounted at a first position in the housing where the joint terminal is retracted from the insertion spaces for the terminal fittings. However, the joint terminal can be moved to a second position in the housing where the joint terminal enters the insertion spaces and contacts the terminal fittings.

The joint terminal is held at the first position while the terminal fittings are being inserted into the housing. Thus, the joint terminal does not significantly resist insertion of the terminal fittings. The joint terminal is moved to the second position after the terminal fittings have been inserted into the housing. Thus, the joint terminal contacts and shorts the terminal fittings in the housing. The joint terminal is mounted in the housing without a separate holder. As a result, the number of parts can be reduced.

Leading ends of contacts of the joint terminal may fit in the leading ends of the terminal fittings when the joint terminal is at the first position. Thus, the contacts will not collide with the terminal fittings as the joint terminal is displaced to the second position.

The joint terminal may lightly touch resilient contacts of the terminal fitting when the joint terminal is at the first position. However, such contact preferably does not deform the resilient contact piece significantly.

The resilient contacts of the terminal fitting preferably are deformed maximally when the joint terminal is at the second position.

The joint terminal preferably has a wide rectangular main portion and long contacts that extend from an edge of the main portion. The contacts preferably are continuous and substantially flush with the main portion.

Locking pieces preferably project out and forward from a plane that contains the main portion and the contacts. The locking pieces engage the housing to prevent movement of the joint terminal towards the second position. First projections preferably project out from the main portion substantially in the plane containing the main portion and the contacts. The first projections engage the housing to prevent movement of the joint terminal from the housing.

The invention also relates to a method of assembling a joint connector. The method comprises providing a housing with insertion spaces for accommodating terminal fittings. The method proceeds by mounting a joint terminal at a first position in the housing so that the joint terminal does not project significantly into the insertion spaces for the terminal fittings. The method then includes mounting the terminal fittings in the insertion spaces and moving the joint terminal to a second position for shorting contact with the terminal fittings in the insertion spaces.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
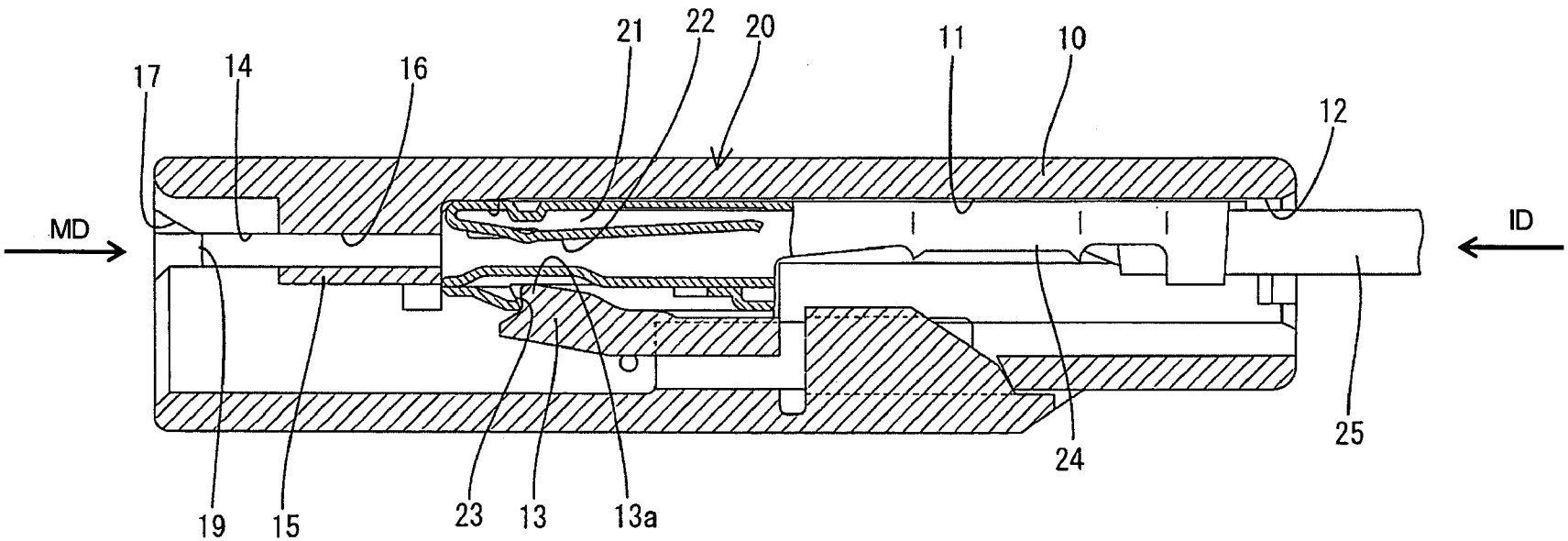
FIG. 1 is a longitudinal section of a housing of the invention with a terminal fitting in the housing and a joint terminal detached from the housing.
Figure 2:
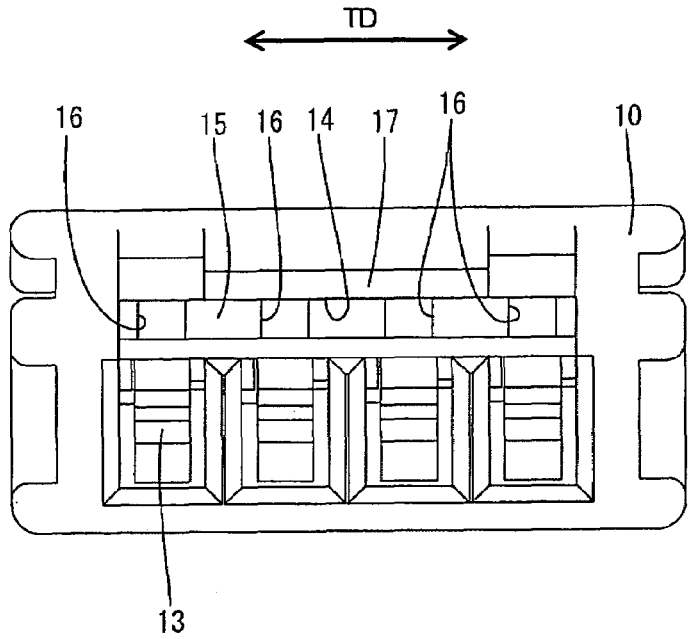
FIG. 2 is a front view of the housing.
Figure 3:
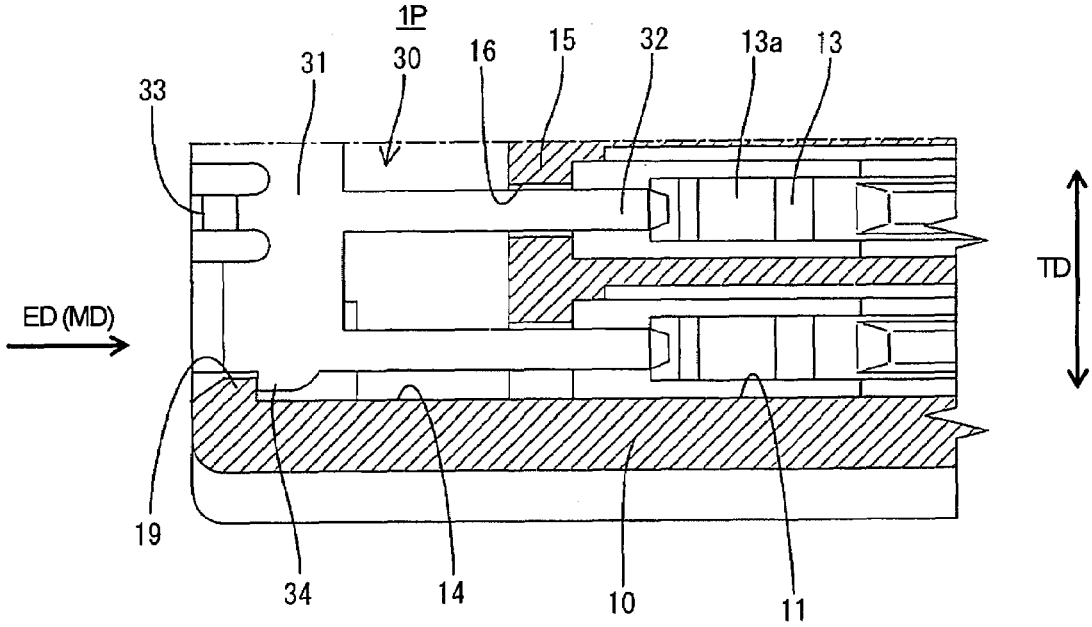
FIG. 3 is a partial enlarged horizontal section showing a state where the joint terminal is at a partial locking position.
Figure 4:
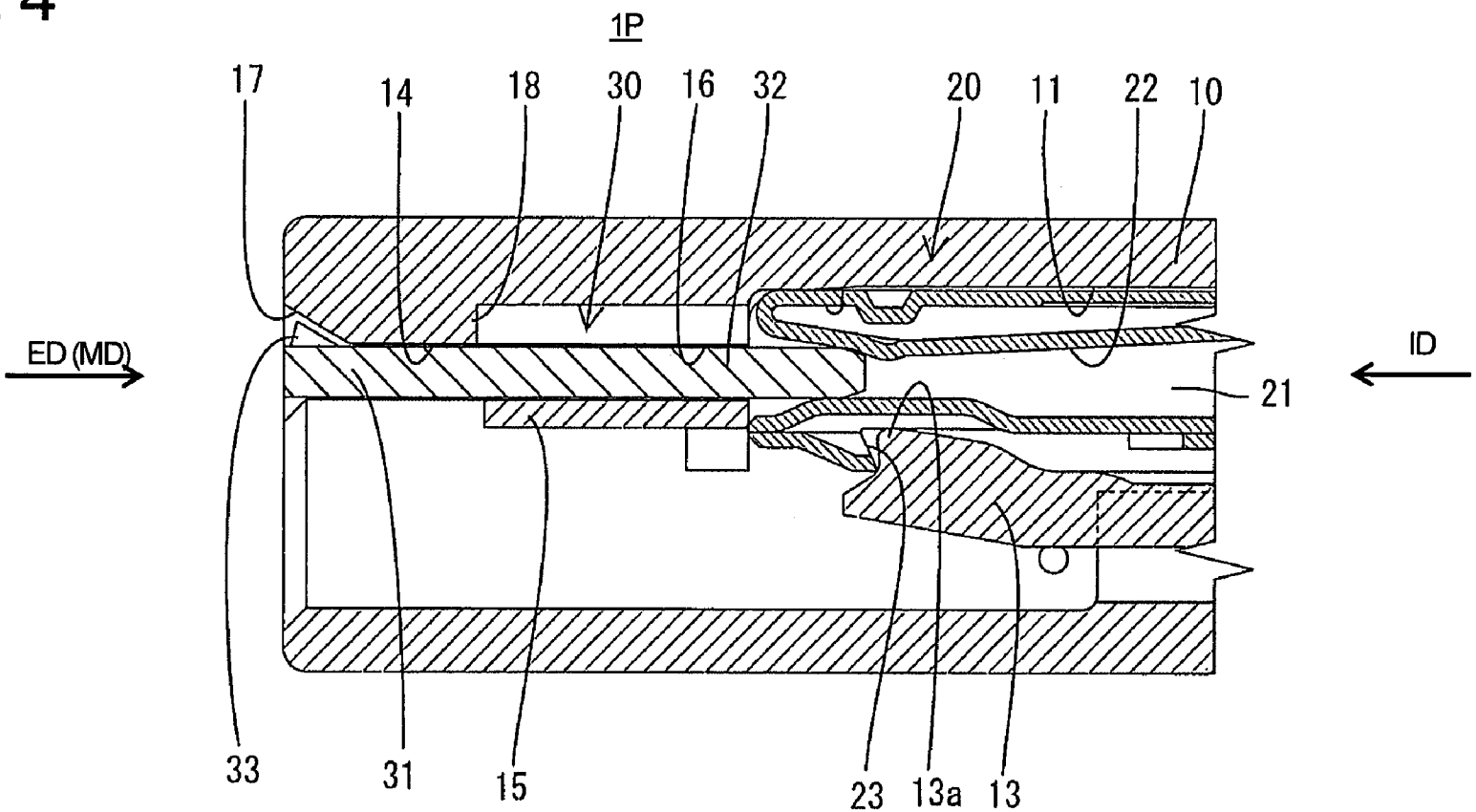
FIG. 4 is a partial enlarged longitudinal section showing a state where the terminal fittings are inserted while the joint terminal is at the partial locking position.
Figure 5:
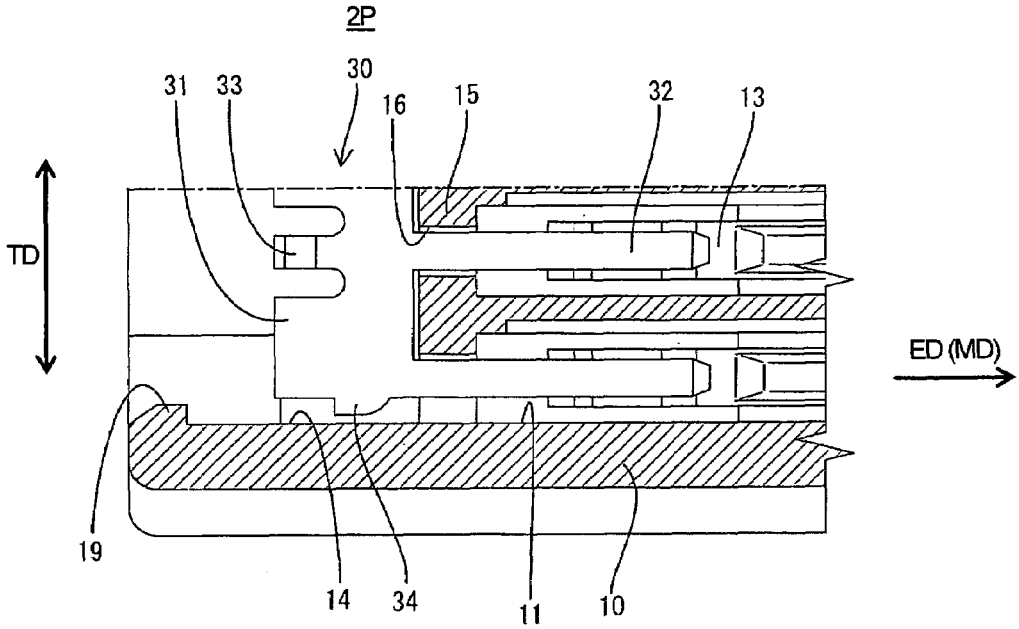
FIG. 5 is a partial enlarged horizontal section showing the joint terminal at a full locking position.
Figure 6:
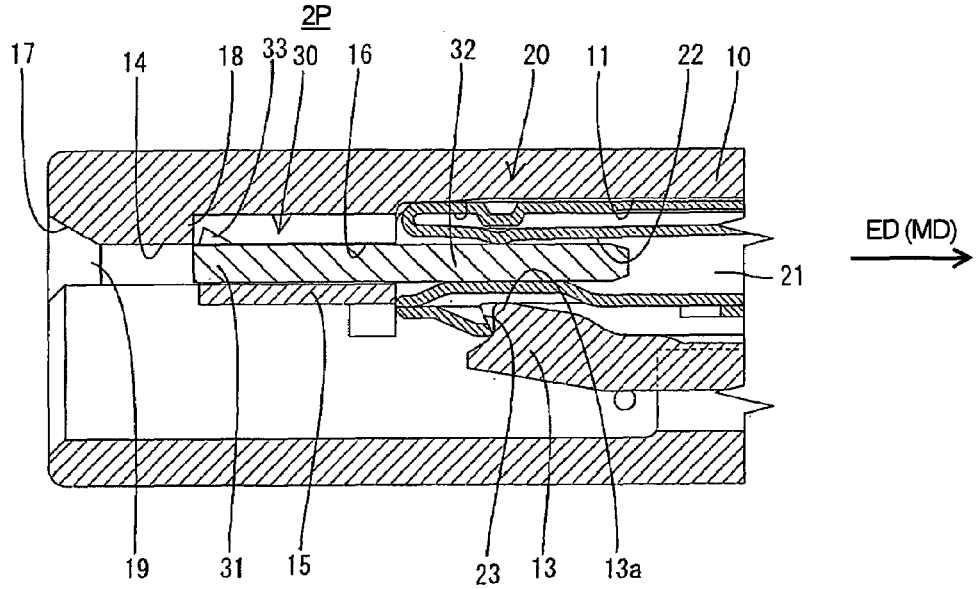
FIG. 6 is a partial enlarged longitudinal section showing the joint terminal at the full locking position.
Figure 7:
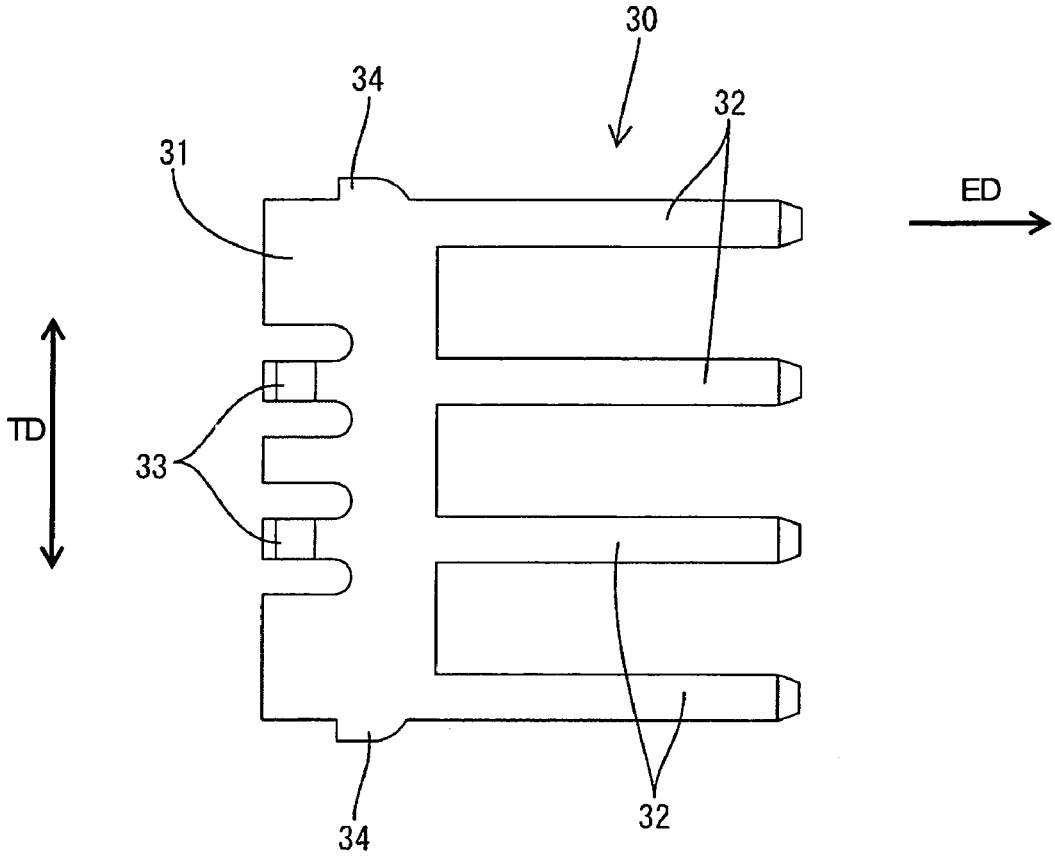
FIG. 7 is a plan view of the joint terminal.
Figure 8:
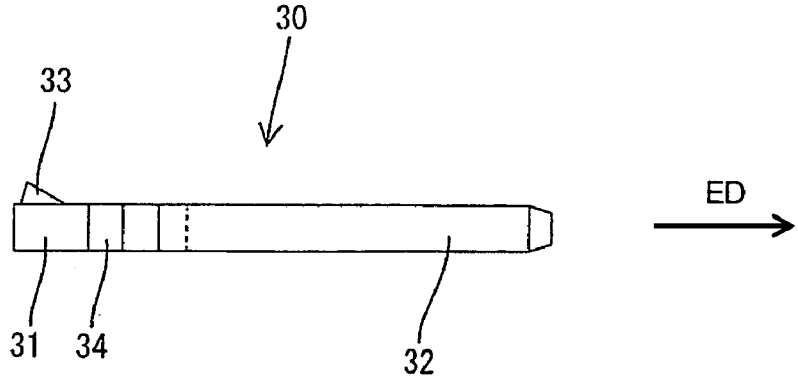
FIG. 8 is a side view of the joint terminal.

A joint connector according to the invention has a housing identified by the numeral 10 in FIGS. 1 to 6. The housing 10 is made e.g. of a synthetic resin and is substantially in the form of a flat block with opposite front and rear ends. Long narrow cavities 11 extend through the housing 10 in forward and backward directions and are arranged substantially side by side along a transverse direction TD. A terminal insertion opening 12 extends into each cavity 11 at the rear end of the housing 10. Locks 13 are formed unitarily with the housing 10 and are cantilevered forward along the bottom wall of the respective cavities 11. Each lock 13 is resiliently deformable up and down towards and away from the respective cavity 11.

A wide slit-shaped guiding groove 14 is formed in the front end surface of the housing 10 and extends across a transverse area corresponding to the cavities 11. Upper and lower surfaces of the guiding groove 14 are flat and extend substantially parallel to an inserting direction ID defined by the cavities 11. A partition wall 15 partitions the guiding groove 14 and the cavities 11, and guiding holes 16 penetrate the partition wall 15 in substantially forward and backward directions from the rear surface of the guiding groove 14 to the front surfaces of the cavities 11. Upper and lower surfaces of the guiding holes 16 are substantially continuous and flush with the corresponding surfaces of the guiding groove 14. A forwardly and upwardly slanted partial-locking surface 17 is formed at the front end of the upper surface of the guiding groove 14. Step-shaped left and right full locks 18 are formed on the upper surface of the guiding groove 14 at positions behind the slanted partial-locking surface 17 and step-shaped partial locks 19 are formed in the left and right surfaces of the guiding groove 14.

The joint connector further includes female terminal fittings 20. Each terminal fitting 20 is long and narrow in forward and backward directions and has opposite front and rear ends. A tubular fitting 21 is formed at the front end of each terminal fitting 20, and the interior of the tubular fitting 21 is open at the front end. A resilient contact piece 22 is provided in the tubular fitting 21, and a locking hole 23 is formed in the bottom wall of the tubular fitting 21 for engaging a retaining projection 13*a* of the lock 13. A wire connecting portion 24 is formed at the rear end of the terminal fitting 20 and is configured to be crimped, bent or folded into connection with a wire 25. The connected wire 25 extends back from the terminal fitting. The terminal fitting 20 is configured to be inserted into the cavity 11 from behind and along the inserting direction ID.

The joint terminal 30 is made of a substantially flat conductive metal sheet stamped or cut out into a specified shape. More particularly, the joint terminal 30 has a substantially rectangular main portion 31 that is wide in the transverse direction TD. Long narrow contacts 32 extend back in an extending direction ED from a rear edge of the main portion 31. The contacts 32 are continuous and substantially flush with the main portion 31. The front edge of the main portion 31 is cut and bent to form left and right locks 33 that rise obliquely up to the front and out of the plane that contains the main portion 31 and the contacts 32. Left and right partial locks 34 project out from the opposite left and right edges of the main portion 31 substantially in the plane of the main portion 31 and the contacts 32.

The joint terminal 30 is mounted in the housing 10 before the terminal fittings 20 are inserted into the housing 10. More particularly, the joint terminal 30 is inserted into the guiding groove 14 from the front and along a mounting direction MD and is left at a partial locking position 1P. The main portion 31 is at a front area in the guiding groove 14 and the rear ends of the respective contacts 32 project slightly into the cavities 11 through the guiding holes 16 when the joint terminal 30 is at the partial locking position 1P. The guiding groove 14 prevents displacements of the main portion 31 along the vertical direction and the transverse direction TD. Additionally, guiding holes 16 prevent displacements of the contacts 32 along the vertical direction and the transverse direction TD. Further, the locking pieces 33 engage the slanted partial-locking surface 17 from the front to prevent backward displacement of the joint terminal 30 in the mounting direction MD. Still further, the partial locking projections 34 engage the partial locks 19 from behind to prevent movement of the joint terminal 30 opposite to the mounting direction MD. In this way, the joint terminal 30 is held at the partial locking position 1P.

The joint terminal 30 can be moved from the partial locking position 1P to a full locking position 2P by pushing the main portion 31 from the front and along the mounting direction MD. The contacts 32 extend farther into the cavities 11 when the joint terminal 30 is moved to the full locking position 2P than when the joint terminal 30 is at the partial locking position 1P. Further, backward movement of the joint terminal 30 is prevented by the contact of the rear edge of the main portion 31 with the front end surface of the partition wall 15, and a forward returning movement of the joint terminal 30 towards the partial locking position 1P is prevented by the engagement of the left and right locking pieces 33 with the full locking portions 18 from behind. As a result, the joint terminal 30 can be held at the full locking position 2P.

The joint terminal 30 is mounted into the housing 10 from the front and along the mounting direction MD. As a result, the joint terminal 30 is held at the partial locking position 1P. The terminal fittings 20 then are inserted into the corresponding cavities 11 from behind and along the inserting direction ID. In the inserting process, the tubular fitting 21 contacts the retaining projection 13*a* to deform the lock 13 down and out. The lock 13 resiliently returns when the terminal fitting 20 reaches a properly inserted state so that the retaining projection 13*a* engages the locking hole 23. As a result, the terminal fitting 20 is retained. When the terminal fitting 20 is inserted properly, the leading end of the corresponding contact 32 of the joint terminal 30 is fit lightly in the tubular fitting 21. At this time, the contact 32 lightly touches the resilient contact piece 22 to an extent that hardly deforms the resilient contact piece 22.

The joint terminal 30 is pushed substantially in the extending direction ED from the partial locking position 1P to the full locking position 2P after all of the terminal fittings 20 are inserted. The contacts 32 slide in contact with the lower surfaces of the resilient contact pieces 22 during the pushing process and gradually deform the resilient contact pieces 22. The resilient contact pieces 22 are deformed maximally when the joint terminal 30 reaches the full locking position 2P. As a result, the contacts 32 and the resilient contact pieces 22 are connected electrically with contact pressures resulting from resilient restoring forces of the resilient contact pieces 22. In this way, the terminal fittings 20 are shorted by the joint terminal 30.

The joint terminal 30 is mounted into the housing 10 in the embodiment described above. However, it is not necessary to provide means for holding the joint terminal 30 in addition to the housing 10, thereby reducing the number of parts.

Further, the joint terminal 30 mounted in the housing 10 is displaceable between the full locking position 2P where the joint terminal 30 enters the cavities 11 and the partial locking position 1P where the joint terminal 30 is retracted forwardly from the cavities 11. Accordingly, insertion of the terminal fittings 20 into the housing 10 creates substantially no insertion resistance by the contact of the joint terminal 30 and the terminal fittings 20 when the joint terminal 30 is at the partial locking position 1P. Therefore, there is no likelihood of hindering the insertion of the terminal fittings 20.

The leading ends of the contacts 32 of the joint terminal 30 are fit in the leading ends of the terminal fittings 20 with the joint terminal 30 held at the partial locking position 1P. Thus, the contact portions 32 can enter the tubular fittings 21 and can be connected without colliding with the terminal fittings 20 when the joint terminal 30 is displaced to the full locking position 2P.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The terminal fittings are female terminal fittings in the foregoing embodiment. However, the invention is also applicable to male terminal fittings.

The number of the terminal fittings (number of contacts) is four in the foregoing embodiment. However, it may be two, three, five or more.

The contacts of the joint terminal contact the terminal fittings with the joint terminal held at the partial locking position in the foregoing embodiment. However, the joint terminal need not contact the terminal fittings when the joint terminal is at the partial locking position.

What is claimed is:

1. A joint connector, comprising:

a housing having insertion spaces;

terminal fittings to be accommodated in the insertion spaces in the housing; and a joint terminal having a substantially planar main portion, long narrow contacts extending in an extending direction from an edge of the main portion, locking pieces extending substantially opposite from the extending direction and rising out of the plane of the main portion, the joint terminal being mounted in the housing and being displaceable between a first position substantially retracted from the insertion spaces for the terminal fittings and a second position where the joint terminal enters the respective insertion spaces for contacting and shorting the terminal fittings, the locking pieces contacting portions of the housing to prevent movement of the joint terminal towards the second position.

2. The joint connector of claim 1, wherein the contacts are continuous and substantially flush with the main portion.

3. The joint connector of claim wherein 1, wherein partial locks project out from the main portion substantially in the plane of the main portion and the contacts, the partial locks engaging portions on the housing to prevent the joint terminal from moving in a direction to exit the housing.

4. The joint connector of claim 1, wherein leading ends of contacts of the joint terminal are fit partly in leading ends of the terminal fittings when the joint terminal is at the first position.

5. The joint connector of claim 4, wherein the contacts of the joint terminal lightly touches resilient contact pieces of the terminal fittings to an extent to hardly deform the respective resilient contact piece.

6. The joint connector of claim 4, wherein resilient contacts of the terminal fitting are deformed maximally when the joint terminal is at the second position.

7. A joint connector, comprising:

a housing formed with opposite front and rear ends, insertion spaces extending forward into the rear end for receiving terminal fittings, the housing being formed with at least one partial lock and at least one full lock; and a joint terminal mounted rearwardly into the front end of the housing and being displaceable between a first position where the joint terminal is at least partly retracted from the insertion spaces and a second position where the joint terminal enters more deeply into the insertion spaces, the joint terminal being formed with at least one partial lock engageable directly with the partial lock of the housing and configured for releasably holding the joint terminal in the first position and at least one main lock engageable directly with the full lock of the housing for substantially locking the joint terminal in the second position.

8. The joint connector of claim 7, wherein the comprises at least one partial lock comprises first and second partial locks for releasably holding the joint terminal in the first position and wherein the at least one main lock comprises first and second main locks for substantially locking the joint terminal in the second position.

9. The joint connector of claim 7, wherein the housing further has a surface for engaging the main lock when the joint terminal is at the first position for resisting movement of the joint terminal to the second position.

10. The joint connector of claim 7, wherein the joint terminal has a substantially planar main portion and contacts extending from the main portion towards the insertion spaces of the housing, the main lock and the partial lock being formed to extend from the main portion.

11. A joint connector, comprising:

a housing formed with insertion spaces for receiving terminal fittings, the housing being formed with at least one partial lock and at least one full lock; and a joint terminal mounted in the housing and having a substantially planar main portion and contacts extending from the main portion towards the insertion spaces of the housing, the joint terminal being displaceable between a first position where the contacts are at least partly retracted from the insertion spaces and a second position where the contacts enter more deeply into the insertion spaces, the main portion being formed with at least one partial lock for engaging the partial lock of the housing to releasably hold the joint terminal in the first position, the main portion further having at least one main lock for engaging the full lock of the housing to lock the joint terminal in the second position, the main lock extends out of a plane defined by the substantially planar main portion.

12. The joint connector of claim 11, wherein the partial lock is substantially in the plane of the main portion.

13. The joint connector of claim 12, wherein the main portion and the contacts are substantially coplanar.

* * * * *